US005431407A

United States Patent [19]

Hofberg et al.

[11] Patent Number: 5,431,407

[45] Date of Patent: Jul. 11, 1995

[54] METHOD OF PLAYING A CASINO CARD GAME

[76] Inventors: Renee B. Hofberg, 777 W. Germantown Pike, Apartment 420; Robert Hofberg, 777 W. Germantown Pike, both of Plymouth Meeting, Pa. 10462

[21] Appl. No.: 314,639

[22] Filed: Sep. 29, 1994

[51] Int. Cl.[6] ..... A63F 1/00

[52] U.S. Cl. ..... 273/292; 273/309

[58] Field of Search ..... 273/309, 292, 274

[56] References Cited

U.S. PATENT DOCUMENTS

| | | | |
|---|---|---|---|
| 3,998,462 | 12/1976 | Goott | 273/274 |
| 4,362,303 | 12/1982 | Pell | 273/274 |
| 4,492,378 | 1/1985 | Williams | 273/142 HA |
| 5,098,107 | 3/1992 | Boylan et al. | 273/292 |

*Primary Examiner*—Benjamin H. Layno

[57] ABSTRACT

A casino card game is disclosing which uses a deck of cards having series of individual cards which can be arranged into an ordered card sequence such as a poker deck. In the play of the game an initial card is randomly selected to start the game. The selected card is used as the starting point in a game sequence that is the same as the card sequence of the deck except that it is started at position in the sequence established by the selected card. The cards are opened one at a time from the deck. As each card is opened its position in the ordered sequence is compared to the what is the next position in the game sequence. If the opened card does not match the card in the game sequence a second card is opened and compared with the next position in the game sequence. If there still is no match a third card is opened and the process repeated until there is a match or the entire game sequence is completed without a match. The house win if there is a match. The players win if sufficient cards are opened to go through the entire game sequence without a match.

19 Claims, 2 Drawing Sheets

METHOD OF PLAYING A CASINO CARD GAME

BACKGROUND OF THE INVENTION

1. Field of the Invention

This invention relates to a casino card game. More particularly, this invention is concerned with a card game with easy to understand rules that is played against a casino and which includes the opportunity for multiple wagering on various possible outcomes at each play of the cards.

2. Description of Related Prior Art

The gaming industry, and in particular casino type gambling, has become a rapidly growing business. As a result of the substantial increase in the number of casinos, a need to has developed to interest new players in casino gaming. The use of cash promotions and complementary benefits can bring new potential players into a casino once or twice. However to make first or second time visitors into regular players, it is important that the casino games be interesting and exciting and most importantly, be easy to understand and play.

The games that are traditionally played in casinos vary widely in the complexity of the rules required to play the games and the skill involved in the play. In general, the more interesting and exciting the game, the more skill and personal involvement of the player is required. This tends to discourage novice players from trying certain of the more interesting casino games.

The easiest game to play in a casino, from a skill level, is single play slots. Winning or losing and the payoffs are the result of a random selection by the slot machine. A player merely pulls a lever and hopes for a winning combination of cherries, bells, lemons or other objects to appear in a horizontal row. Slots rapidity become boring for many new players. In addition, since each play is relatively short, there is little long term involvement and the type of wagering is limited.

Video poker games have been added to most casinos as an alternative that is more interesting and challenging. In video poker the player has the option of selecting how many card to draw and which cards to discard. Video poker, like slots, has the disadvantage of being a solitary game played against a machine. This is not appealing to many players interested in the social interaction and excitement of playing with other players. A further disadvantage of video poker is that it does not play like a poker card game, which involves other players and a greater degree of challenge.

Blackjack is a card game which requires more skill and player involvement. A degree of luck is required to win, but a player with an understanding of the game, and particularly the odds of winning, can enhance his chances. It is also a more social game, involving other players and a dealer. Blackjack is an important casino game in that players who do not like slots or video poker can graduate to blackjack. The basic rules of blackjack are relatively simple to understand and the players actively participate in the play of the game by making decision about whether to take an additional card or hold onto the cards dealt based upon the point value of the hand and what is shown by the dealer. In addition, there are wagering decisions involved between cards dealt and decisions about whether to split pairs and the like. Blackjack is also an ideal game for casinos. The casino is an active participant in blackjack which is preferable to most card games, such as conventional poker, where the casino typically only renders services for a fee by providing tables for play and a nonplaying dealer. Various numbers of players can participate, from one to as many as the dealer can reasonable handle, without changing the play of the game. In addition, the players do not have physical contact with the cards, which substantially reduces cheating as a result of marking of the cards. A disadvantage of blackjack for the casino is that the play of an individual hand is relatively short, the opportunities for wagering are limited and the odds can be beaten by card counting. The finer points of blackjack can also be difficult for novice players to fully understand, such as insurance and splitting of pairs, which can make the difference between winning and losing.

A game that has wide spread appeal among older experienced gamblers is craps. Craps is one of the most interesting and challenging games played in the casino. The roll of the dice to establish the initial point and the series of rolls of the dices until the point is made or the player loses creates extended interest and excitement in the game. Between each roll of the dice, players can make wagers on the outcome of the next roll. The wagering includes different types of bets as to what will be rolled and different odds for the different types of wagers. The extended play and the opportunity to make different types of wagers before each roll of the dice increases the interest and involvement of the players in the game. The interest and appeal of craps can easily be seen in any casino where people visiting the casinos especially of the first time tend to stand around the craps tables and watch the game being played. The game of craps has many desirable attributes for a casino game. There is an extended play of the game, there are multiple opportunities to wager and different types of wagers with different odds are involved. Craps is interesting for the players, as skill and an understanding of the odds are required, giving the game a loyal following. The problem with craps as a casino game is that most crap players are older persons who learned the rules of the game playing on the street comer. Most younger players, and especially novice players just coming to the casinos, do not understand the rules and are intimidated by the game of craps. In addition, most players are accustomed to card games. The use of dice for gambling is unfamiliar and uncomfortable. As a result, younger players and novice players, while interested in the game of craps, are afraid to play it. As a result, the number of craps players is getting less and less as older players stop playing and new players do not even begin to play the game. An additional problem with craps is that the individual players handle the dice, which increases the chances of cheating.

What would be highly desirable would be a casino card game having the positive attributes of craps, including being interesting and challenging to play; involving a number of possible plays to complete a game; allowing players to make wagering decisions between plays of the game; playable equally well with a different number of players; having multiple and different types of wagering before each card is played; and being played against the casino. It would also be desirable if the card game had the desirable attributes of blackjack, including allowing only the dealer to contact the playing cards, but having rules of play more easily understood by the novice player. A card game which could be played as a live table game and also as a video game, without a difference in rules and play, would also be highly desirable.

SUMMARY OF THE INVENTION

A casino card game is disclosed which uses a deck of cards having a series of individual cards which can be arranged into an ordered card sequence, such as a poker deck. In the play of the game the deck is shuffled and a card in the game sequence is randomly selected by roll of the dice, spin of a wheel or random electronic selection. The selected card is used as the starting point in a game sequence which is the same as the card sequence of the deck except that it is started at a position in the sequence established by the selected card. Additional cards are opened one at a time from the deck. As each card is opened, its position in the ordered sequence is compared to the next position in the game sequence. If the opened card does not match the card in the game sequence, a second card is opened and compared with the next position in the game sequence. If there still is no match, a third card is opened and the process is repeated until there is either a match or the entire game sequence is completed without a match. The house wins if there is a match. The players win if sufficient cards are opened to go through the entire game sequence without a match.

An opening wager that the game sequence will be completed without a match is placed by each player before any cards are played. In addition, after the starting point in the game sequence is established, the players can place side wagers. Side wagers can be made by the players before each card is opened. The side wagers include wagers as to the specific card which will be opened next; whether the next card drawn will be a high or low card in the card sequence; and wagers that there will be a match at a specific position in the game sequence, that is a "break card" in the sequence. An additional wager that can be made as a side bet is what will be the suit of the next card drawn, that is, whether the next card will be a spade, heart, club or diamond.

The card game of this invention is preferably played on a table layout specifically designed for the game. The table layout includes indicia explaining rules of the game, the card sequence, positions for placing various type of side wagers and the odds for each type of wager. The game, because of its simplicity, can also be programmed to play on a video terminal.

DETAILED DESCRIPTION OF THE PREFERRED EMBODIMENTS

The term "casino card game" as used in this specification refers to a card game in which the "house," typically a casino, acts as the banker, collects all losing wagers and pay all winning wagers, and is the dealer of the game. The individual players play against the house and not against each other.

The card game of this invention is played with a deck of cards. The deck of cards can be especially made for play of the game. Decks of cards suitable for play of the game include a plurality of sets of cards which can be arranged in identical ordered sequences. The number of sets of cards in the deck must be at least four or more. Each card in a set of cards carries indicia so that the cards can be arranged in order such as being numbered. The number of cards in the sets can be varied with lower of number of cards resulting in shorter games and lower odds and greater number of card resulting in generally longer games and greater odds. The number of cards in each set is preferably from six to twenty with about thirteen giving the optimum play of the The preferred deck of card for play of the game is a standard straight poker deck. A standard poker deck has four sets or suits of cards, namely spades, hearts, diamonds and clubs. In each suit there are thirteen cards that can be arranged in an ordered sequence. The setup of a poker deck is ideal for play of the game in a casino in that the number of sets and number of cards in each set results in interesting and exciting play of the game. In addition poker decks are readily available in a casino and are familiar to players making the players more comfortable playing the game. In order to facilitate the further explanation of the card game specific reference, will be made to playing the game with a poker deck. However, it should be appreciated that the card game can be played with other types of decks of cards, as indicated above.

The preferred card sequence of the cards for play of the card game of this invention with a poker deck is ace, 2,3,4,5,6,7,8,9,10, jack, queen, king. This sequence allows the cards to be evenly split into high card and low cards with the seven card in the center position. The denomination of the cards, that is whether it is a two or a king, does not have any value in the card game, except for placement of the card in the card sequence. The suit designation, that is, whether the card is a heart or a spade, does not enter into the play of the game.

Figure 1:
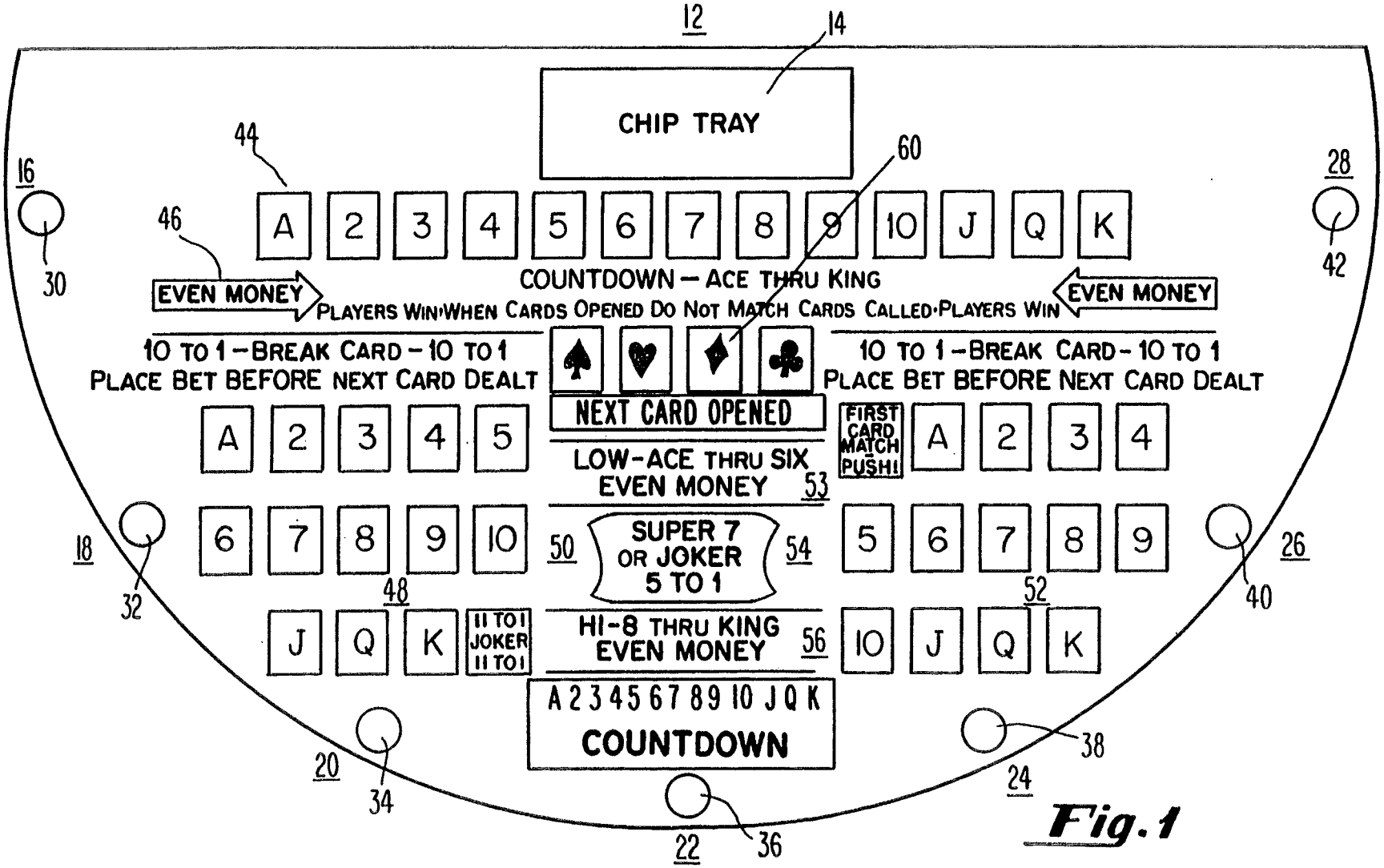
FIG. 1 is a top plan illustration of a game table layout for use in the play of the card game of this invention.

The play of the game will be illustrated with specific reference to the game layout 10 shown in FIG. 1. It should be appreciated however, that the game can be played with a different layout or without the use of a layout and still be within the scope of this invention.

The game layout 10, as shown in FIG. 1, is semicircular and adapted to be placed on a conventional casino gaming table of the type normally used to play blackjack. The dealer position 12 is at the center of the back edge of the game layout 10. An area 14 is provided in front of the dealer for placement of a chip tray to be used by the dealer to hold chips for paying off winning wagers and to place the chips collected on losing wagers. Around the circumference of the game layout 10 there are positions for the players 16,18,20,22,24,26,28 and a series of marked locations 30,32,34,36,38,40,42 for placement of the initial wager by each player. The number of player positions is determined by the number of players a dealer can effectively handle with a maximum of seven players being a general satisfactory number.

Figure 2:
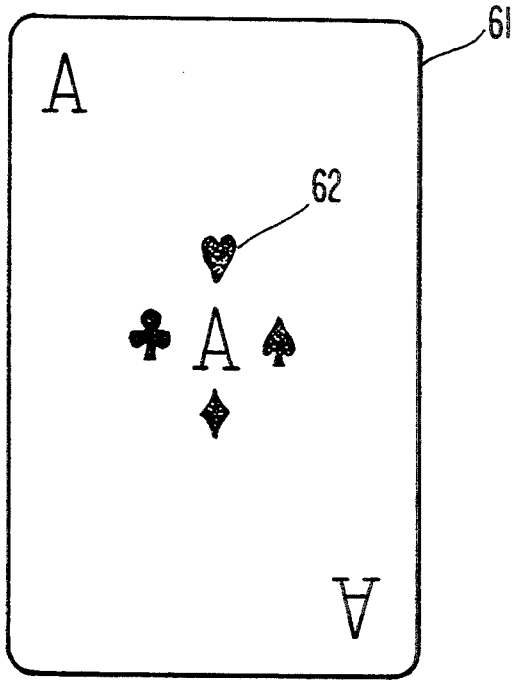
FIG. 2 is an enlarged illustration of a preferred embodiment showing a typical card indicia for use in the array of card in the sequence having all the suit symbols around the card position in the sequence.

In front of the chip tray area 14 is a representation of an array of cards 44 in card sequence, starting with an ace and ending with a king. In the preferred embodiment of the invention each of the card indicia 61 in the array have the symbols 62 for all of the card suits displayed thereon as shown in FIG. 2. This arrangement has the advantage that it makes clearer to the player that a card of any suit but of a matching position in the sequence is a matching or "break" card in the play of the game. Below the representation of the card sequence 44, there is an explanation 46 of the play of the game concerning completion of the game sequence without a match and the pay off odds. In the casino play of the game, the dealer places each card as it is opened on the array 44 at the active position in the game sequence until a match card is opened or the entire game sequence is completed without a match.

Below the representation of the array of cards in sequence 44, there are three separate areas for placement of side wagers 48,50,52. In the first area 48, there is shown a sequence of cards arranged in three rows that corresponds to the cards in the deck to be used in the play of the game. Wagers are placed in this area 48 as to the projected next card opened. The wagers are placed on the selected card designation. In the center area 50 of the game layout 10, three sections 53,54,56 are provided for placement of wagers as to the position of the next card opened in the card sequence. The first section 53 is for wagers that the next card opened will be a low card, that is, ace, 2,3,4,5 or 6, in the card sequence. The second section 54 is optional and is for placement of wagers that one or the other of two identified cards will be opened as the next card. The third section 56 is for placement of a wager that the next card opened will be a high card, that is an 8,9,10, jack, queen or king. An optional section 60 is shown for placement of wagers as to the suit of the next card drawn. The third wagering area 52 is similar to the first wagering area 48, having representations of the cards in the game sequence. In this third area 52, wagers are placed on the designation for the selected card in the game sequence where it is believed a "break card" will be opened, that is, where a card will be opened which will match the position in the game sequence and thereby end the game in favor of the "house."

Figure 3:
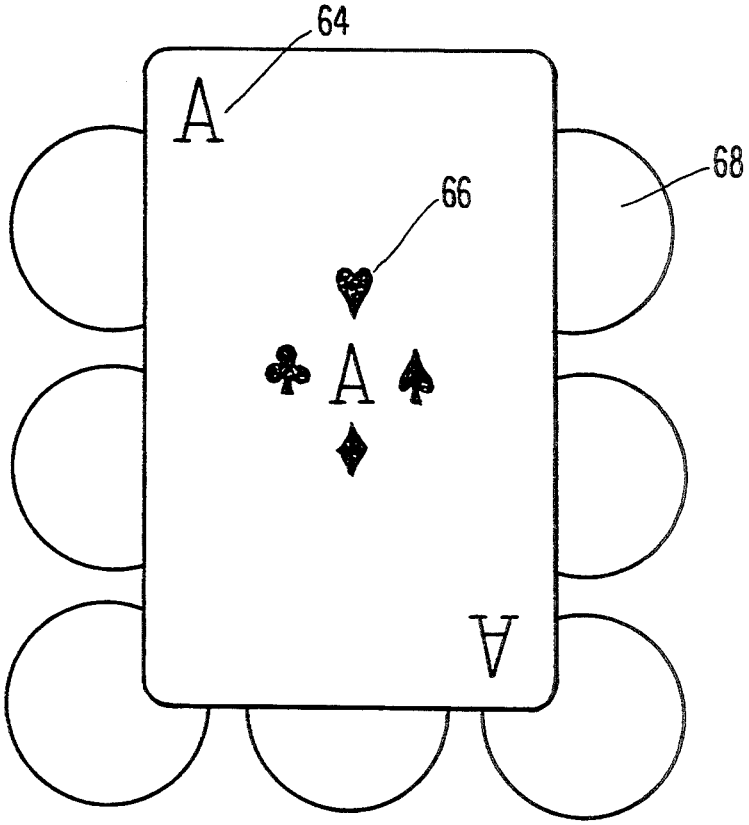
FIG. 3 is an illustration showing a typical card for use in placement of wagers having all of the suits symbols around the card position in the sequence and further having marking for placement of wagers around the outer edge which correspond to the positions of the players.

A preferred embodiment of this invention is shown in FIG. 3 in which the indicia for cards 64 in areas 44 and 56 include the symbol for each of the suits 66 showing that a card of any suit, but of the correct position in the sequence, wins. In addition the indicia for the card 64 also has a series of positions 68 for placement of wagers. The positions 68 correspond to the location of the players 16, 18, 20, 22, 24, 28, about the game layout 10. This feature allows the dealer to more easily keep track of the wagers placed by each of the players. It also eliminates the use of different colored chips for each player.

In the play of the game a single shuffled fifty-two card poker deck is used for the play and a second deck is shuffled and held ready for the next game. The shuffling of the deck is preferably done with a shuffling device, such as the commercially available Shuffle Master II card shuffler.

The individual players place their initial wagers that the game sequence will be completed without a match. An opening card is randomly selected preferably by an electronic device, by rolling dice or use of a wheel. Once the opening card is selected it is used as the starting point in the game sequence for the game. If, for example, a six is drawn as the opening card, the game sequence for the game will be 6,7,8,9,10, jack, queen, king, ace, 2,3,4,5. If on the other hand the opening card is a queen, the game sequence will be queen, king, ace, 2,3,4,5,6,7,8,9,10, jack.

Before the first game card, that is a card used in the play of the game, is opened and before each additional game card is opened the players can place side wagers. The side wagers include what will be the next card opened, whether the card will be a high card or low card, whether the opened card will be one of two designated cards, and the position in the remaining game sequence where a match will be made. When using a game layout 10, as shown in the FIG. 1, the side bets are placed at the location on the game layout as indicated above.

The first game card is drawn and opened. The position of the card in the card sequence is compared with the opening position in the game sequence. If there is a match, that is, if the card opened matches the card in the game sequence, the house wins and the game is ended.

If there is no match of the first game card opened and the starting position of the game sequence, a second card is opened. The second card is compared to the second position in the game sequence. If there is a match of the card opened and the position in the game sequence, the game is ended and the house wins. If there is no match, the procedure is repeated for each consecutive position in the game sequence until there is a match and the game ends with the house wining or the entire game sequence is completed without a match and game ended with the player winning.

In an alternate preferred embodiment of this card game, if there is a match of the opening position in the game sequence on the first game card drawn, it is considered a "push" and the house does not win and a new first game card is drawn. This is only done for the initial card drawn. The house wins if the replacement card also matches the opening position of the game sequence. This alternative embodiment has the advantage maintaining the player's interest since a loss on the very first card could discourage a player from continuing to play.

In a still further embodiment of this invention, a number of non-sequence cards can be included in the deck of cards. A non-sequential card is a card that is not part of the game sequence. The card does not have specific value and can be, for instance, a joker. In play of the game when a non-sequential card is opened, it is treated as a non-matching card and the game advances to the next position in the game sequence. The number of non-sequential cards included in the deck is determined by the casino, as the number of non-sequential cards can be used to adjust the odds. The more non-sequential cards in the deck, the more favorable the odds for the player. The number of non-sequential cards included in the deck is preferably between one and four. An advantage to the casino of the addition of non-sequential cards is that the cards, such as a joker, can be used as a unique card for side wagers as to what card will be opened next. The non-sequential cards can be assigned more favorable odds than the cards in the sequence to increase the excitement in the play of the game The non-sequential card may also be used in a combination wager with another card to provide an additional wagering opportunity. The non-sequential card, for example a joker, and the seven card can be used in a side wager as to whether either card will be opened next, with improved odds for winning.

The actual playing odds of the card game, including whether the game sequence will be completed without a match, odds of a particular card being opened next and the specific position in the game sequence where there will be a match, are readily calculated using wellknown techniques. The specific odds for the card game of this invention is dependent on several interrelated factors including the number of cards in the sets of cards used in the play of the card game, whether the deck contains non-sequential cards, the number of such cards in the deck relative to the total number of cards in the deck, and whether a push is allowed on the first play of the game. In addition, as the game is played and cards are opened, the odds change with respect to the cards remaining in the deck. The effect on the odds of the addition of non-sequential cards, such as jokers, in the preferred method of playing the card game wherein a poker deck is used and wherein a push is allowed if there is a match on the first card play is as follows:

(a) no jokers—45% player, 55% house—10% house advantage
(b) one joker—46% player, 54% house—8% house advantage
(c) four jokers—48% player, 52% house—4% house advantage.

The odds for the different types of wagers shown in the figure are given by way of illustration. The odds paid for each type of wager is set by the individual casino depending upon the particular rate of return desired for the card game.

The play of the card game of this invention is interesting and challenging for both experienced and novice players. The rules of play are straight forward and are readily and easily understood even by players having no prior gaming experience. The rules clearly are better understood by novice players than the rules for blackjack. The actual play of the game holds the interest of the players. In many ways the play of the game of this invention is similar to craps. The play starts with the selection of the starting point in the game sequence, which can be compared to the initial roll of the dice. Then there is the possibility of a number of plays until a match is made or the sequence is completed without a match, that has the same elements of suspense as the series of rolls of the dice in craps. There is also the opportunity to make both the main wager on whether the sequence will be completed without a match and side wagers on a number of possible outcomes based upon the card opened on each play. This again is similar to the game of craps, where side wagers can be made on various possible outcomes of the roll of the dice. A big difference is that the various possibilities for side wagers are substantially easier to understand with the game of this invention than with craps. A further advantage of the card game of this invention over craps is that it is played with cards and preferably a poker deck, which is more acceptable to most newer players in the casino. In addition, in the play of the game, only the dealer need handle the cards and the players do not come in direct contact with the cards allowing greater game security.

The card game of this invention can also readily be programmed to play on a video terminal, if desired, without any change or modification of the rules of play. This is a considerable advantage, in that the game can be played by players who would rather play by themselves against a machine, and also by persons who want to initially try the game in private rather than at a table with other players.

There are other variations and modifications of the card game which will become apparent to those skilled in the art after having been made aware of the disclosure in the above specification. These variations and modifications are within the scope of this invention. Accordingly the invention should not be limited to the description in the foregoing specification but, should be defined by the subjoined claims.

What is claimed is:

1. A method of playing a card game with a house and a player using a deck of cards comprised of a plurality of sets of cards, with each set of cards being comprised of a series of cards that can be arranged in the same ordered sequence, said method comprising the steps of:

(a) randomly selecting an opening card;
(b) using the position of the opening card in the ordered sequence, as the starting position in a game play sequence, said game play sequence being the same as the ordered sequence with the exception that the game play sequence starts the position of the opening card in the ordered sequence;
(c) opening a first game card from the deck and comparing its position in the ordered sequence to the first position in the game play sequence;
(d) if the first game card matches the first position in the game play sequence the game is ended with the house winning;
(e) if the first game card does not match the first position in the game sequence, continuing opening and comparing additional game cards in sequence with the remaining positions in the game sequence until a match is made and the game ended with the dealer winning or the entire game sequence being completed without a match, and the game is ended with the player winnings.

2. The method of playing a card game according to claim 1, wherein the sets of cards contain six to twenty cards and there are at least four sets in the deck.

3. The method of playing a card game according to claim 1 wherein the deck of cards is a fifty-two card poker deck.

4. The method of playing a card game according to claim 3, wherein when the first game card matches the first position in the game play sequence the dealer does not win and the game is restarted by opening a new first game card.

5. The method of playing a card game according to claim 4, wherein the deck of cards contains a non-sequential card that is not part of the ordered sequence and which, when opened, advances the play to the next position in the game sequence.

6. The method of playing a card game according to claim 5 wherein the deck contains from one to four non-sequential cards.

7. The method of playing a card game according to claim 3, wherein the player wagers at the start of the game that the game sequence will be completed without a match.

8. The method of playing a card game according to claim 3, wherein the player wagers at the start of play and before each game card is opened as to the position of the next opened card in the ordered sequence.

9. The method of playing a card game according to claim 3, wherein before each card is opened the player wager on whether the card opened will be higher or lower than the midpoint in the ordered sequence of cards.

10. The method of playing a card game according to claim 3, wherein before each card is opened the player wager on whether on the suit of the next card opened.

11. A game layout for play of the card game according to claim 3 having indicia showing an ordered sequence of cards and indicia for placement of a wager.

12. The game layout according to claim 11, wherein the indicia for placement of wagers includes indicia for placement of wagers as to whether the next card played will be higher or lower than the midpoint in the sequence.

13. The game layout according to claim according to claim 11, wherein the indicia for placement of wagers includes indicia for placement of wagers as to next card opened.

14. The game layout according to claim 11, wherein the indicia for placement of wagers includes indicia for placement of wagers as to the position in the sequence where a matching card will be drawn.

15. The game layout according to claim 11, wherein the indicia for placement of wagers includes indicia for placement of wagers as to the suit of the next card drawn.

16. The game layout according to claim 11, wherein the indicia for placement of wagers includes a statement of odds paid on wagers.

17. The game layout according to claim 11, wherein the indicia for placement of wagers includes indicia for placement of wagers as to whether one of two identified cards will be drawn next.

18. The method of playing a card game according to claim 3 wherein, the game is played on a game layout having indicia showing the ordered sequence of cards, having indicia for placement of a wager as to the next card drawn, indicia for placement of wagers as to whether the next card play will be high or low, indicia for placement of wagers as to the suit of the next card drawn and indicia showing the wagering odds.

19. The method of playing a card game according to claim 3 wherein the game is played on a video display terminal.

* * * * *